United States Patent [19]

Cox

[11] 3,936,542

[45] Feb. 3, 1976

[54] METHODS OF CONTROLLING MIGRATION OF SYNTHETIC RESINS APPLIED TO POROUS MATERIALS

[75] Inventor: Andrew John Cox, Usk, United Kingdom

[73] Assignee: Johnson & Johnson, New Brunswick, N.J.

[22] Filed: Nov. 15, 1973

[21] Appl. No.: 416,342

[52] U.S. Cl. ..... 427/288; 427/302; 427/303; 427/323; 427/324; 427/326

[51] Int. Cl.[2] ..... B05D 5/00

[58] Field of Search ..... 117/47 R, 66, 139.5 CQ, 117/140 A; 427/288, 302, 303, 323, 324, 326

[56] References Cited

UNITED STATES PATENTS

| | | | |
|---|---|---|---|
| 3,384,502 | 5/1968 | Japs | 117/140 A |
| 3,822,143 | 7/1974 | Wheelock | 117/140 A |

*Primary Examiner*—Michael R. Lusignan

[57] ABSTRACT

A method of applying a stable, aqueous, low viscosity resin composition to porous or absorbent materials and controlling the migration thereon which comprises: treating the porous or absorbent materials with an alkaline material to raise its pH above about 7 and give it an alkaline reserve potential; and applying to the porous or absorbent materials a stable, aqueous, acidic low viscosity resin composition having a viscosity of less than about 1,000 centipoises and an acidic pH less than about 7 and comprising from about 10% to about 60% by weight on a solids basis of a synthetic resin and from about 0.3% to about 8% by weight of a low viscosity, self-thickening resin having a polycarboxylate capability of converting the aqueous, acidic low viscosity resin composition to an aqueous, neutral or alkaline high viscosity resin composition having a viscosity of more than about 3,000 centipoises upon neutralization by conversion of the polycarboxylic function therein from the acid form which exists at an acidic pH less than about 7 to an alkali or ammonium carboxylate salt form which exists at about a neutral pH or an alkaline pH greater than about 7, whereby the resin composition substantially immediately thickens in place on the porous or absorbent material with a minimum of migration thereon.

11 Claims, 1 Drawing Figure

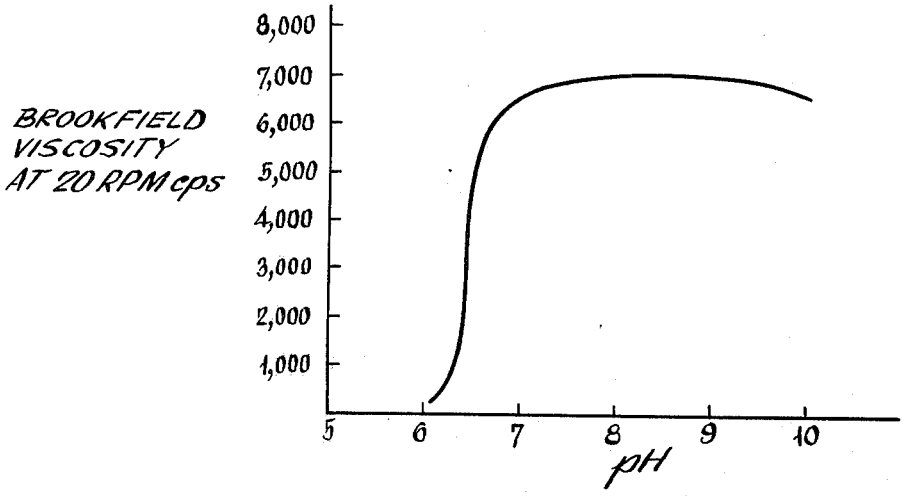
BROOKFIELD
VISCOSITY
AT 20 RPM cps
8,000
7,000
6,000
5,000
4,000
3,000
2,000
1,000
5
6
7
8
9
10
pH

METHODS OF CONTROLLING MIGRATION OF SYNTHETIC RESINS APPLIED TO POROUS MATERIALS

The present invention relates to: improved stable, aqueous synthetic resin compositions; methods of utilizing the same; and the resulting products. More specifically, the present invention relates to stable, aqueous synthetic resin compositions which are intended to be applied to porous or absorbent materials such as textile materials, paper, paper products, wood, leather polyurethane and other foams, wallboard, concrete cinder block, etc.; to methods of applying such synthetic resin compositions to such porous or absorbent materials on which or into which the extent of the migration, diffusion, penetration, or spreading of such synthetic resin compositions is controlled; and to the porous materials so treated with these synthetic resin compositions.

GENERAL BACKGROUND

In many industries such as the textile, paper, paper products, wood, leather, polyurethane foam, printing arts, decorative arts, building materials and like industries, there is often a need to apply a stable, aqueous resin composition to porous or absorbent materials and to maintain such resin composition in the same shape, size and configuration, as well as in the same location, on the porous or absorbent materials where it was originally applied without undesirably migrating, penetrating, or spreading materially therefrom in any direction to any substantial extent on or into the porous or absorbent materials.

Such resins have found use in the coating industries for the coating of woven, knitted, nonwoven and other textile fabrics, paper, paper products and other related materials. The resins are also used as adhesives for laminating materials or for binding fibrous webs. These resins have also found wide use as additives in the manufacture of paper, the printing industry, the decorative printing of textiles, and in other industries.

PURPOSES AND OBJECTS

It is therefore a principal purpose and object of the present invention to provide improved, stable, aqueous low viscosity resin compositions which can be applied to porous or absorbent materials in such fashion as to control the extent of the migration, diffusion, penetration or spreading of the resin composition on or into the porous or absorbent materials.

STATEMENT OF THE INVENTION

It has been found that such purpose and object, as well as other purposes and other objects which will become clear from a further reading hereof, may be achieved by treating porous or absorbent materials with an alkaline material to raise its pH above about 7 and give it an alkaline reserve potential; and then applying to the porous or absorbent materials a stable, aqueous, acidic low viscosity resin composition having a viscosity of less than about 1,000 centipoises and an acidic pH less than about 7 and comprising from about 10% to about 60% by weight, and preferably from about 20% to about 50% by weight, on a solids basis of a synthetic resin; from about 0.3% by weight to about 8% by weight, and preferably from about 0.5% to about 5% by weight, all percentages being based on the weight of the resin composition, of a low viscosity, self-thickening resin having a polycarboxylate capability of converting the aqueous, acidic low viscosity resin composition to an aqueous, neutral or alkaline high viscosity resin composition having a viscosity of more than about 3,000 centipoises upon neutralization by conversion of the polycarboxylic function therein from the acid form which exists at an acidic pH less than about 7 to an alkali or ammonium carboxylate salt form which exists at about a neutral pH or an alkaline pH greater than about 7, whereby the resin composition substantially immediately thickens in place on the porous or absorbent material with a minimum of migration thereon.

GENERAL DESCRIPTION OF THE INVENTION

In the following specification and accompanying drawings, there are described and illustrated preferred embodiments of the invention but it is to be understood that the inventive concept is not to be considered limited to the embodiments disclosed except as determined by the scope of the appended claims.

GENERAL DESCRIPTION OF THE DRAWING

Referring to the drawing, there is shown a graph of viscosities vs pH values showing the effect of neutralization with ammonia of a composition comprising the self-thickening resin used in Example 1 of this specification. Attention is called to the highly viscous nature of the gel produced over the pH range of from about 6.5 to about 10. The abrupt rise in viscosities from a very low value to a plateau of about 7,000 is notable.

PREFERRED ILLUSTRATIVE EMBODIMENT

The present invention will be described in greater particularity herein purely for illustrative but not limitative purposes insofar as it relates to porous, absorbent fibrous sheet materials and to their methods of manufacture. More particularly, however, the present invention is concerned with the so-called bonded, "nonwoven" textile fabrics, i.e. fabrics produced from textile fibers without the use of conventional spinning, weaving, knitting or felting operations.

Although not limited thereto, the invention is of primary importance in connection with nonwoven fabrics derived from "oriented" or carded fibrous webs composed of textile-length fibers, the major proportion of which are oriented predominantly in one direction.

Another aspect of the present invention is its application to nonwoven fabrics wherein the textile-length fibers were originally predominantly oriented in one direction but have been reorganized and rearranged in predetermined designs and patterns of fabric openings and fiber bundles.

Still another aspect of the present invention is its application to nonwoven fabrics wherein the textile-length fibers are disposed at random by air-laying techniques and are not predominantly oriented in any one direction. Typical nonwoven fabrics made by such procedures are termed "isotropic" nonwoven fabrics.

And still another aspect of the present invention is its application to nonwoven fabrics which comprise wood pulp fibers and/or textile-length fibers and which are made basically by conventional or modified aqueous paper making techniques. Such fabrics are also basically "isotropic" and generally have like properties in all directions.

The conventional base starting material for the majority of these nonwoven fabrics is usually a fibrous web comprising any of the common textile-length fibers, or mixtures thereof, the fibers varying in average length from approximately ½ inch to about 2½ inches. Exemplary of such fibers are the natural fibers such as cotton and wool and the synthetic or man-made cellulosic fibers, notably rayon or regenerated cellulose.

Other textile-length fibers of a synthetic or man-made origin may be used in various proportions to replace either partially or perhaps even entirely the previously-named fibers. Such other fibers include: polyamide fibers such as nylon 6, nylon 66, nylon 610, etc.; polyester fibers such as "Dacron", "Fortrel" and "Kodel"; acrylic fibers such as "Acrilan", "Orlon" and "Creslan"; modacrylic fibers such as "Verel" and "Dynel"; polyolefinic fibers derived from polyethylene and polypropylene; cellulose ester fibers such as "Arnel" and "Acele"; polyvinyl alcohol fibers; etc.

These textile-length fibers may be replaced either partially or entirely by fibers having an average length of less than about one-half inch and down to about one-quarter inch. These fibers, or mixtures, thereof, are customarily processed through any suitable textile machinery (e.g., a conventional cotton card, a "Rando-Webber", a paper-making machine, or other fibrous web producing apparatus) to form a web or sheet of loosely associated fibers, weighing from about 100 grains to about 2,000 grains per square yard or even higher.

If desired, even shorter fibers, such as wood pulp fibers or cotton linters, may be used in varying proportions, even up to 100%, where such shorter length fibers can be handled and processed by available apparatus. Such shorter fibers have lengths less than ¼ inch.

The resulting fibrous web or sheet, regardless of its method of production, is then subjected to at least one of several types of bonding operations to anchor the individual fibers together to form a self-sustaining web. One method is to impregnate the fibrous web over its entire surface area with various well-known bonding agents, such as natural or synthetic resins. Such over-all impregnation produces a nonwoven fabric of good longitudinal and cross strength, acceptable durability and washability, and satisfactory abrasion resistance. However, the nonwoven fabric tends to be somewhat stiff and boardlike, possessing more of the properties and characteristics of paper or board than those of woven or knitted textile fabric. Consequently, although such over-all impregnated nonwoven fabrics are satisfactory for many uses, they are still basically unsatisfactory as general purpose textile fabrics.

Another well-known bonding method is to print the fibrous webs with intermittent or continuous straight or wavy lines, or areas of binder extending generally transversely or diagonally across the web and additionally, if desired, along the fibrous web. The resulting nonwoven fabric is far more satisfactory as a textile fabric than over-all impregnated webs in that the softness, drape and hand of the resulting nonwoven fabric more nearly approach those of a woven or knitted textile fabric.

The printing of the resin binder on these nonwoven webs is usually in the form of relatively narrow lines, or elongated rectangular, triangular or square areas or annular, circular, or elliptical binder areas which are spaced apart a predetermined distance which, at its maximum is preferably slightly less than the average fiber constituting the web. This is based on the theory that the individual fibers of the fibrous web should be bound together in as few places as possible.

These synthetic resin colloidal dispersions, or synthetic resin emulsions, or latexes, may be anionic, nonionic or even polyionic, and are available commercially at pH's of from about 2½ to about 10, and usually from about 2½ to about 6½, which latter range is the pH range of the application of the present inventive concept. In the event that it is desired to use a particular synthetic resin which is available commercially in a pH range greater than 6½, then the synthetic resin must first be acidified to bring the pH to the range of between about 2½ and about 6½ before the carboxylated self-thickening or swelling resin is added thereto. This acidification is accomplished by adding to the synthetic resin emulsion sufficient amounts of an acid, such as acetic acid, for example, to bring the pH to the desired acidic range. It is imperative, however, that the addition of the acid to the synthetic resin emulsion does not affect or destroy its stability and that the synthetic resin emulsion remain in a stable condition.

The amount of resin solids which is applied to the porous or absorbent material varies within relatively wide limits, depending upon the resin itself, the nature and character of the porous or absorbent materials to which the resins are being applied, its intended use, etc. A general range of from about 4% by weight up to about 50% by weight, based on the weight of the porous or absorbent material, is satisfactory under substantially all uses. Within the more commerical limits, however, a range of from about 10% to about 30% by weight, based on the weight of the porous or absorbent material, is preferred.

Such bonding increases the strength of the nonwoven fabric and retains substantially complete freedom of movement for the individual fibers whereby the desirable softness, drape and hand are obtained. This spacing of the binder lines and areas has been accepted by the industry and it has been deemed necessarily so, if the stiff and board-like appearance, drape and hand of the over-all impregnated nonwoven fabrics are to be avoided.

The nonwoven fabrics bonded with such line and area binder patterns have had the desired softness, drape and hand and have not been undesirably stiff or board-like. However, such nonwoven fabrics have also possessed some disadvantages.

The nominal surface coverage of such binder lines or areas will vary widely depending upon the precise properties and characteristics of softness, drape, hand and strength which are desired in the final bonded product. In practice, the nominal surface coverage can be designed so that it falls within the range of from about 10% to about 50% of the total surface of the final product. Within the more commercial aspects of the present invention, however, nominal surface coverages of from about 12% to about 40% are preferable.

In certain cases, especially where larger proportions of short fibers are used, surface coverages of up to about 85% are often encountered and such are preferred in some applications of the present invention.

The relatively narrow binder lines and relatively small binder areas of the applicator (usually an engraved print roll) which are laid down on the fibrous web possess specified physical dimensions and interspatial relationships as they are initially laid down. Unfortunately, after the binder is laid down on the wet fibrous web and before it hardens or becomes fixed in position, it tends to spread, diffuse or migrate whereby its physical dimensions are increased and its interspatial relationships decreased. And, at the same time, the binder concentration in the binder area is lowered and rendered less uniform by the migration of the binder into adjacent fibrous areas. One of the results of such migration is to make the surface coverage of the binder areas increase whereby the effect of the intermittent bonding approaches the effect of the over-all bonding. As a result, some of the desired softness, drape and hand are lost and some of the undesired properties of harshness, stiffness and boardiness are increased.

It is therefore desirable that the narrow binder lines remain narrow and that they do not migrate into wide binder lines. As pointed out previously, such desirable features are provided by the use of the resin compositions of the present invention.

THE SYNTHETIC RESINS

The synthetic resins may be selected from a relatively large group of synthetic resins well known in industry for bonding, coating, impregnating or related uses, and may be of a self cross-linking type, externally cross-linking type, or not cross-linked. Specific examples of such synthetic resins include: polymers and copolymers of vinyl ethers; vinyl halides such as plasticized and and unplasticized polyvinyl chloride, polyvinyl chloride-polyvinyl acetate, ethylene-vinyl chloride, etc.; polymers and copolymers of vinyl esters such as plasticized and unplasticized polyvinyl acetate, ethylene-vinyl acetate, acrylic-vinyl acetate, etc.; polymers and copolymers of the polyacrylic resins such as ethyl acrylate, methyl acrylate, butyl acrylate, ethylbutyl acrylate, ethyl hexyl acrylate, hydroxyethyl acrylate, dimethyl amino ethyl acrylate, etc.; polymers and copolymers of the polymethacrylic resins such as methyl methacrylate, ethyl methacrylate, isopropyl methacrylate, butyl methacrylate etc.; polymers and copolymers of acrylonitrile, methacrylonitrile, acrylamide, N-isopropyl acrylamide, N-methylol acrylamide, methacrylamide, etc., vinylidene polymers and copolymers, such as polyvinylidene chloride, polyvinylidene chloride-vinyl chloride, polyvinylidene chloride-ethyl acrylate, polyvinylidene chloride-vinyl chloride-acrylonitrile etc.; polymers and copolymers of polyolefinic resins including polyethylene, polypropylene, ethylene-vinyl chloride and ethylene-vinyl acetate which have been listed previously; the synthetic rubbers such as 1,2-butadiene, 1,3-butadiene, 2-ethyl-1,3-butadiene, high, medium and carboxylated butadiene-acrylonitrile, butadiene-styrene, chlorinated rubber, etc.; the polyurethanes; the polyamides; the polyesters; the polymers and copolymers of the styrenes including: styrene, 2-methyl styrene, 3-methyl styrene, 4-methyl styrene, 4-ethyl styrene, 4-butyl styrene; phenolic resin; etc.

These resins may be used either as homopolymers comprising a single repeating monomer unit, or they may be used as copolymers comprising two, three, or more different monomer units which are arranged in random fashion, or in a definite order alternating fashion, within the polymer chain. Also included within the inventive concept are the block polymers comprising relatively long blocks of different monomer units in a polymer chain and graft polymers comprising chains of one monomer attached to the backbone of another polymer chain.

The synthetic resins are present in the resin composition in concentration of from about 10% to about 60% by weight on a dry solids basis, and preferably from about 20% to about 50% by weight on a dry solids basis.

THE SELF-THICKENING RESIN

The low viscosity self-thickening or swelling resin, as normlly commercially available, possesses a low viscosity usually in the range of from about 30 centipoises to about 400 centipoises and normally has a pH in the range of from about 2½ to about 6½. When the pH level is raised, such as by the addition of a base, the resin particles in the emulsion self-thicken and swell to a very great extent forming stable, highly viscous gels or emulsions having viscosities of from about 3,000 to over 100,000 centipoises or even more. For the purpose of the present invention as it relates to the application of synthetic resin compositions to textile materials, such as nonwoven fabrics, viscosities of from about 3,000 to about 10,000 are preferred.

It is believed that the self-thickening or swelling properties are created by the polycarboxylate capability of the resin which, when existing in the polycarboxylic acid form at a pH less than about 7 provides for the low viscosity values but which, when neutralized and converted to the polycarboxylate salt form at a pH equal to or greater than about 7, immediately thickens and provides for the high viscosity values.

Specific examples of low viscosity, self-thickening or swelling resin include homopolymers of alpha, beta-unsaturated carboxylic acids such as acrylic acid, methacrylic acid, fumaric acid, maleic acid, itaconic acid, crotonic acid, isocrotonic acid, angelic acid, tiglic acid, etc. Copolymers of such polymerizable unsaturated acids with other polymerizable materials are also of value, provided sufficient percentage concentrations of the carboxylic acid function (—COOH) are present in the copolymer and are available for neutralization and conversion by a base to the carboxylate salt function. For the purposes of the present invention, the minimum percentage concentration must be greater than about 9% by weight. Examples of such other co-polymerizable monomeric materials include: vinyl halide, vinyl ester, or vinyl ether monomers including for example, vinyl chloride, vinyl acetate and vinyl ethyl ether; olefin monomers such as ethylene and propylene; acrylic and methacrylic monomers including for example, ethyl acrylate, ethyl hexyl acrylate, methyl acrylate, propyl acrylate, butyl acrylate, hydroxyethyl acrylate, dimethyl amino ethyl acrylate, methyl methacrylate, ethyl methacrylate, isopropyl methacrylate, butyl methacrylate, acrylonitrile, methacrylonitrile, acrylamide, N-isopropyl acrylamide, N-methylol acrylamide, methacrylamide; vinylidene monomers such as vinylidene chloride; diene monomers including for example, 1,2-butadiene, 1,3-butadiene, 2-ethyl-1,3 butadiene; styrene monomers including for example, styrene, 2-methyl styrene, 3-methyl styrene, 4-methyl styrene, 4-ethyl styrene, 4-butyl styrene; etc.

The self-thickening or swelling resin is present in the resin composition in concentrations of from about 0.3% to about 8% by weight on a dry solids basis, and preferably from about 0.5% to about 5% by weight on a dry solids basis. Higher concentrations may be used such as up to 10% or 15% by weight but is uneconomical and does not add to the efficiency or effectiveness of the process involved.

Other improvement or modifying materials may also be included in the resin compositions. Such materials would include surfactants, primarily anionic or nonionic; pigments, dyes and other coloring agents; antifoam agents; antioxidants; etc.

THE ALKALINE MATERIAL

Ammonium hydroxide is the preferred alkaline material or base which is used to neutralize the carboxylic acid function by converting it to the carboxylate salt function. Other alkaline materials, however, may also be used depending on the particular circumstances and requirements involved. Such other alkaline materials include, for example, other inorganic bases including alkali metal hydroxides such as sodium hydroxide, potassium hydroxide, lithium hydroxide, etc.; sodium carbonate and sodium bicarbonate; sodium phosphate and dibasic sodium phosphate; sodium perborate; sodium silicate; organic bases such as ethanolamine, diethanolamine, triethanolamine, morpholine, alkylamines such as ethylamine, propyl amine, butyl amine, etc.

The amount of ammonium hydroxide which is applied to the porous or absorbent materials must be sufficient not only to raise its pH to above about 7 but it must be sufficient to subsequently neutralize and convert the polycarboxylic acid function (—COOH) of the self-thickening synthetic resin to the polycarboxylate salt function (—COOCation) and maintain the ultimate pH of the resin composition at or above about 7. It is to be observed that maximum viscosity of the resin composition is obtained when the ultimate pH is in the range of from about 7.5 to about 8.5.

The ammonium hydroxide may be applied to the porous or absorbent materials in any desired convenient fashion, such as by saturation in a dip or wet-out section, or by passing the printed porous or absorbent materials over ammonia fumes, substantially immediately after printing of the binder pattern. In any event, regardless of whether the porous or absorbent materials are pretreated with ammonium hydroxide, or whether they are post-treated with ammonia fumes after printing, the applied acidic binder must be converted substantially immediately to the alkaline condition as soon as it is applied to the porous or absorbent materials to control and limit the migration of the binder.

As used herein, unless specifically designated other, viscosity readings in centipoises are Brookfield, No. 2 spindle at 60 revolutions per minute at 25°C.

The invention will be further illustrated in greater detail by the following specific examples. It should be understood, however, that although these examples may describe in particular detail some of the more specific features of the invention, they are given primarily for purposes of illustration and the invention in its broader aspects is not to be construed as limited thereto.

EXAMPLE I

A fibrous card web weighing about 525 grains per square yard and comprising 100% rayon fibers 1½ denier and 1 9/16 inches in length is treated with 28% ammonium hydroxide and is intermittently print pattern bonded by the rotogravure processs using a binder applying roll engraved with 4 diamond-pattern print lines per inch, each line being 0.024 inch in width.

The resin binder composition comprises:

| | Parts by Weight As Received | Parts by Weight of Active Solids | % Solids |
|---|---|---|---|
| i) National 125-2859 | 124.4 | 55.8 | 95.4 |
| ii) Mono ammonium phosphate | 0.4 | 0.4 | 0.72 |
| iii) Water | 3.6 | | |
| iv) Monastral Fast Green GNVS | 0.5 | 0.29 | 0.50 |
| v) Water | 2.5 | | |
| vi) Water | 61.4 | | |
| vii) Viscalex HV30 | 6.5 | 1.95 | 3.33 |
| viii) Antifoam RD | 0.7 | 0.07 | 0.12 |
| | | 58.51 | 100.00 |

i) a vinyl acetate/acrylate copolymer latex at 45% solids content.
ii) a corrosion inhibitor and latent acid catalyst for promoting the self-crosslinking reaction of i).
iii) water to solvate ii) prior to mixing.
iv) colourant at 57% solids content.
v) diluent water for iv) prior to mixing.
vi) diluent water for vii).
vii) base-activated polyacrylic acid thickener at 30% solids content.
viii) silicone emulsion antifoam at 10% solids content.

The viscalex HV30, as supplied, has a pH 2.5–3.0, a viscosity of 5cps (Brookfield, 20rpm) and a specific gravity of 1.05.

The pH of the resin binder composition is acidic and is below 7. Upon being deposited on the ammonia-treated fibrous web, its pH is raised to above 7 (range about 7.8–8.3) and the resin binder composition thickens immediately in place with substantially no further migration.

The treated nonwoven fabric is dried. The resin solids add-on is 125 grains per square yard bringing the finished nonwoven fabric weight to 650 grains per square yard. Examination of the finished nonwoven fabric reveals that the binder migration is minimal and well within acceptable limits.

EXAMPLE II

The procedures of Example 1 are followed substantially as set forth therein with the exception that the Viscalex HV30 self-thickener is replaced by Viscalex EM15 which is a mobile, white unneutralized acidic polyacrylate emulsion of an acrylic copolymer of vinyl acetate and a lower alkyl acrylate (presumably ethyl acrylate) containing free carboxyl groups.

The results are generally comparable to those obtained in Example 1. Examination of the finished nonwoven fabric reveals that binder migration is minimal and is well within commercially acceptable limits.

EXAMPLE III

The procedures of Example 1 are followed substantially as set forth therein with the exception that the Viscalex HV30 self-thickener is replaced by Primal ASE-60 which contains carboxylic acid groups and is a cross-linked 50:50 anionic copolymer of ethyl acrylate and acrylic acid (28% solids). As received, the pH is approximately 3.5, the viscosity is 4 cps (Brookfield, 12 rpm, 25°C.)

The results are generally similar to those obtained in Example 1. Examination of the finished nonwoven fabric reveals that binder migration is minimal and is well within commercially acceptable limits.

EXAMPLE IV

The procedures of Example 1 are followed substantially as set forth therein with the exception that the vinyl acetate/acrylate copolymer is replaced by HA-8 which is essentially polyethyl acrylate.

The results are generally similar to those obtained in Example 1. Examination of the finished nonwoven fabric reveals that binder migration is minimal and is well within commercially acceptable limits.

EXAMPLE V

The procedures of Example 1 are followed substantially as set forth therein with the exception that the vinyl acetate/acrylate copolymer is replaced by Hycar 2600H1060 which is a modified butadiene-stryene copolymer.

The results are generally similar to those obtained in Example 1. Examination of the finished nonwoven fabric reveals that binder migration is minimal and is well within commercially acceptable limits.

EXAMPLE VI

A fibrous card web weighing about 525 grains per square yard and comprising 100% rayon fibers 1½ denier and 1 9/16 inches in length is treated with 28% ammonium hydroxide and is intermittently print pattern bonded by the rotogravure process using a binder applying roll engraved with 4 diamond-pattern print lines per inch, each line being 0.024 inch in width.

The resin binder composition comprises:

| | Pounds |
|---|---|
| Anti Foam | 0.01 |
| Polyethyl acrylate (46% solids) | 8.0 |
| Water | 2.0 |
| 50:50 Copolymer of ethyl acrylate and acrylic acid (28% solids) | 1.5 |
| Hydroxy ethyl cellulose (2%) | 1.0 |
| Pigment | 0.5 |
| | 13.01 |

This is equivalent to 27.75% by weight of polyethyl acrylate and 3.23% by weight of the copolymer of ethyl acrylate and acrylic acid. The aqueous copolymer, as supplied, is anionic, has a pH of 3.5, a solids content of 28%, and a viscosity of 4, Brookfield reading, 12 rpm at 25°C.

The pH of the resin binder composition is acidic and is below 7. Upon being deposited on the ammonia-treated fibrous web, its pH is raised to above 7 (range about 7.8 – 8.3) and the resin binder composition thickens immediately in place with substantially no further migration.

The treated nonwoven fabric is dried. The resin solids add-on is 125 grains per square yard bringing the finished nonwoven fabric weight to 650 grains per square yard. Examination of the finished nonwoven fabric reveals that the binder migration is minimal and well within acceptable limits.

EXAMPLE VII

A fibrous card web weighing about 525 grains per square yard and comprising 100% rayon fibers 1½ denier and 1 9/16 inches in length is treated with 28% ammonium hydroxide and is intermittently print pattern bonded by the rotogravure process using a binder applying roll engraved with 4 diamond-pattern print lines per inch, each line being 0.024 inch in width.

The resin binder composition comprises:

| | Pounds |
|---|---|
| Anti Foam | 0.01 |
| Polyethyl acrylate (46% solids) | 14.0 |
| Water | 1.5 |
| 50:50 Copolymer of Ethyl Acrylate and Acrylic Acid (28% solids) | 0.3 |
| Pigment | 0.2 |
| | 16.01 |

This is equivalent to 40.2% by weight of polyethyl acrylate and 0.52% by weight of the copolymer of ethyl acrylate and acrylic acid. The aqueous copolymer, as supplied is anionic, has a pH of 3.5, a solids content of 28%, and a viscosity of 4, Brookfield reading, 12 rpm at 25°C.

The pH of the resin binder composition is acidic and is below 7. Upon being deposited on the ammonia-treated fibrous web, its pH is raised to above 7 (range 7.9–8.2) and the resin binder composition thickens immediately in place with substantially no further migration.

The treated nonwoven fabric is dried. The resin solids add-on is 125 grains per square yard bringing the finished nonwoven fabric weight to 650 grains per square yard. Examination of the finished nonwoven fabric reveals that the binder migration is minimal and well within acceptable limits.

EXAMPLE VIII

A fibrous card web weighing about 525 grains per square yard and comprising 100% rayon fibers 1½ denier and 1 9/16 inches in length is treated with 28% ammonium hydroxide and is intermittently print pattern bonded by the rotogravure process using a binder applying roll engraved with 4 diamond-pattern print lines per inch, each line being 0.024 inch in width.

The resin binder composition comprises:

| | Pounds |
|---|---|
| Anti Foam | 0.01 |
| Polyethyl acrylate (46% solids) | 14.0 |
| Water | 1.5 |
| 50:50 Copolymer of Ethyl Acrylate and Acrylic Acid (28% solids) | 0.6 |
| Pigment | 0.2 |
| | 16.31 |

This is equivalent to 40.0% by weight of polyethyl acrylate and 1.04% by weight of the copolymer of ethyl acrylate and acrylic acid. The aqueous copolymer, as supplied, is anionic, has a pH of 3.5, a solids content of 28%, and a viscosity of 4, Brookfield reading, 12 rpm at 25°C.

The pH of the resin binder composition is acidic and is below 7. Upon being deposited on the ammonia-treated fibrous web, its pH is raised to above 7 (range 8.0–8.1) and the resin binder composition thickens immediately in place with substantially no further migration.

The treated nonwoven fabric is dried. The resin solids add-on is 125 grains per square yard bringing the finished nonwoven fabric weight to 650 grains per squard yard. Examination of the finished nonwoven fabric reveals that the binder migration is minimal and well within acceptable limits.

EXAMPLE IX

The procedures of Example VI are followed substantially as set forth therein with the exception that the self-thickening copolymer is a 50:50 copolymer of methyl methacrylate and methacrylic acid. The aqueous copolymer, as supplied, is anionic, has a pH of 3.0, a solids content of 20%, and a viscosity of 50. The results are comparable to those set forth in Example VI and the binder migration control is deemed excellent.

EXAMPLE X

A fibrous card web weighing about 525 grains per square yard and comprising 100% polyethylene glycol tirephthalate polyester fibers 1½ denier and 1 9/16 inches in length is treated with 28% ammonium hydroxide and is intermittently print pattern bonded by the rotogravure process using a binder applying roll engraved with the cross-hatch pattern print line, with each line being 0.032 inch in width.

The resin binder composition comprises:

| | Pounds |
|---|---|
| Anti Foam | 0.001 |
| Polyethyl acrylate (46% solids) | 15.0 |
| 50:50 Copolymer of Ethyl Acrylate and Acrylic Acid (28% solids) | 1.0 |
| Surfactant | 0.08 |
| | 16.081 |

This is equivalent to 47.5% by weight of polyethyl acrylate and 1.6% by weight of the copolymer of ethyl acrylate and acrylic acid. The aqueous copolymer, as supplied, is anionic, has a pH of 3.5, a solids content of 28%, and a viscosity of 4, Brookfield reading, 12 rpm at 25°C.

The pH of the resin binder composition is acidic and is below 7. Upon being deposited on the ammonia-treated fibrous web, its pH is raised to above 7 (about 8) and the resin binder composition thickens immediately in place with substantially no further migration.

The treated nonwoven fabric is dried. The resin solids add-on is 125 grains per square yard being the finished nonwoven fabric weight of 650 grains per square yard. Examination of the finished nonwoven fabric reveals that the binder migration is minimal and well within acceptable limits.

EXAMPLE XI

The procedures of Example VI are followed substantially as set forth therein with the exception that the self-thickening copolymer is replaced by Rohm & Haas "Acrysol" ASE-60 which is a cross-linked acrylic acid emulsion copolymer having an anionic charge. As supplied, it has a viscosity of 4, a pH of 3.5 and 28% solids content. The results are comparable to those obtained in Example VI and the binder migration control is deemed excellent.

EXAMPLE XII

The procedures of Example VI are followed substantially as set forth therein with the exception that the self-thickening copolymer is replaced by Rohm & Haas "Acrysol" ASE-108 which is a cross-linked acrylic acid emulsion copolymer having an anionic charge. As supplied, it has a viscosity of 250, a pH of 3.8 and 20% solids content. The results are comparable to those obtained in Example VI and the binder migration control is deemed excellent.

EXAMPLE XIII

The procedures of Example VI are followed substantially as set forth therein with the exception that the self-thickening copolymer is replaced by Rohm & Haas "Rhoplex" B-15 which is a non-ionic, cross-linkable acrylic acid emulsion.

As supplied, it has a viscosity of 50, a pH of 6.4 and 46% solids content. The results are comparable to those obtained in Example VI and the binder migration control is deemed excellent.

EXAMPLE XIV

The procedures of Example VI are followed substantially as set forth therein with the exception that the self-thickening copolymer is replaced by B. F. Goodrich "Hycar" 2679X6 which is a self-thickening acrylic acid latex having an anionic charge. As supplied, it has a viscosity of 300, a pH of 5.0 and 48.5% solids content. The results are comparable to those obtained in Example VI and the binder migration control is deemed excellent.

EXAMPLE XV

The procedures of Example VI are followed substantially as set forth therein with the exception that the self-thickening copolymer is replaced by polyacrylic acid homopolymer. The results are comparable to those obtained in Example VI and the binder migration control is deemed excellent.

EXAMPLE XVI

The procedures of Example VI are followed substantially as set forth therein with the exception that the rayon fibers are replaced by polyvinyl alcohol fibers having a denier of 1.4 and a length of 44 millimeters.

The results are comparable to the results obtained in Example VI. The binder migration control is satisfactory.

EXAMPLE XVII

The procedures of Example VI are followed substantially as set forth therein with the exception that the synthetic resin (polyethyl acrylate) is replaced by:

a. polyvinyl acetate;
b. ethyl acrylate-vinyl acetate copolymer;
c. ethylene vinyl acetate;
d. butyl acrylate; and
e. polyvinyl chloride (original pH of 8½ requires acidification with acetic acid to pH of 5½)

The results are comparable to those obtained in Example VI. The binder migration control is considered excellent.

Although specific examples of the inventive concept have been described, the same should not be construed as limited thereby nor to the specific features mentioned therein but to include various other equivalent features as set forth in the claims appended hereto. It is understood that any suitable changes, modifications and variations may be made without departing from the spirit and scope of the invention.

What is claim is:

1. A method of print bonding nonwoven fibrous webs in an intermittent print pattern with a stable resin binder composition and controlling the binder migration thereon which comprises:

treating nonwoven fibrous webs with an alkaline material to raise the pH above about 7 to give same an alkaline reserve potential; and applying the stable resin binder composition to said fibrous webs with a binder applying print roll, said resin binder composition having a viscosity of less than 1000 centipoises and comprising a synthetic resin and low viscosity, self-thickening resin having a polycarboxylate capability of converting said acidic resin composition to a neutral or alkaline resin composition having a viscosity of more than 3,000 centipoises upon neutralization and conversion of the polycarboxylic function from the acid form at an acidic pH less than about 7 to an alkali or ammonium carboxylate salt form at a neutral pH of about 7 or an alkaline pH greater than about 7, whereby said resin composition substantially immediately thickens in place on said fibrous webs with a minimum of migration thereon.

2. A method of print bonding non-woven fibrous webs in an intermittent print pattern with a stable resin binder composition and controlling the binder migration thereon which comprises:

treating non-woven fibrous webs with an alkaline material to raise the pH above about 7 to give same an alkaline reserve potential; and applying the stable resin binder composition to said fibrous webs with a binder applying print roll, said resin binder composition having a viscosity of less than about 1000 centipoises and an acidic pH less than about 7 and comprising from about 10% to about 60% by weight on a solids basis of a synthetic resin and from about 0.3% to about 8% by weight based on the weight of the resin composition, of a low viscosity, self-thickening resin having a polycarboxylate capability of converting said acidic low viscosity resin composition to a neutral or alkaline high viscosity resin composition having a viscosity of more than about 3,000 centipoises upon neutralization and conversion of the polycarboxylic function from the acid form at an acidic pH less than about about 7 to an alkali or ammonium carboxylate salt form at a neutral pH of about 7 or an alkaline pH greater than about 7, whereby said composition substantially immediately thickens in place on said fibrous webs with minimum of migration thereon.

3. A method as defined in claim 1 wherein the alkaline material is ammonium hydroxide.

4. A method as defined in claim 1 wherein the pH of the resin composition is in the range of from about 7.6 to about 8.5, after application to said porous materials.

5. A method as defined in claim 1 wherein the viscosity of the low viscosity, self-thickening resin is in the range of from about 4 to about 350 centipoises, Brookfield values, 12 rpm at 25°C.

6. A method as defined in claim 5 wherein the low viscosity, self-thickening resin is polyacrylic acid.

7. A method as defined in claim 5 wherein the low viscosity, self-thickening resin is polymethacrylic acid.

8. A method as defined in claim 5 wherein the low viscosity, self-thickening resin is polyitaconic acid.

9. A method as defined in claim 5 wherein the low viscosity, self-thickening resin is a copolymer of acrylic acid and ethyl acrylate.

10. A method as defined in claim 5 wherein the low viscosity, self-thickening resin is a copolymer of methacrylic acid and methyl methacrylate.

11. A method of print bonding nonwoven fibrous webs in an intermittent print pattern with a stable resin binder composition and controlling the binder migration thereon which comprises:

applying a stable resin binder composition to fibrous webs with a binder applying print roll, said resin binder composition having an acidic pH less than about 7 and having a viscosity of less than 1,000 centipoises and comprising a synthetic resin and a low viscosity self-thickening resin having a polycarboxylate capability of converting said resin composition to a resin composition having a viscosity of more than 3,000 centipoises upon neutralization and conversion of the polycarboxylic function from the acid form at an acidic pH of less than about 7 to an alkali or ammonium carboxylate salt form at an alkaline pH greater than about 7; and substantially immediately neutralizing and converting said polycarboxylic acid function to said polycarboxylate salt function, whereby said resin composition substantially immediately thickens in place on said fibrous webs with a minimum of migration thereon.

* * * * *

UNITED STATES PATENT AND TRADEMARK OFFICE

CERTIFICATE OF CORRECTION

PATENT NO. : 3,936,542

DATED : February 3,1976

INVENTOR(S) : Andrew John Cox

It is certified that error appears in the above-identified patent and that said Letters Patent are hereby corrected as shown below:

In Column 3, line 66, "fiber constituting" should read --- fiber length of the fibers constituting ---.

In Column 5, line 24, "plasticized and and" should read --- plasticized and ---.

In Column 11, line 54, "of" should read --- to ---.

In Column 13, line 5, "claim" should read --- claimed ---.

In Column 14, line 3, "whereby said composition" should read --- whereby said resin composition ---.

Signed and Sealed this

Thirtieth Day of November 1976

[SEAL]

*Attest:*

RUTH C. MASON
*Attesting Officer*

C. MARSHALL DANN
*Commissioner of Patents and Trademarks*